US009044107B2

(12) United States Patent
Golden et al.

(10) Patent No.: US 9,044,107 B2
(45) Date of Patent: Jun. 2, 2015

(54) MODULAR RACK SYSTEM FOR DISPLAYING FLAT ARTICLES

(75) Inventors: Steven B. Golden, Easton, PA (US); Stephen P. Dashe, Bethlehem, PA (US)

(73) Assignee: ArtSkills, Inc.

( * ) Notice: Subject to any disclaimer, the term of this patent is extended or adjusted under 35 U.S.C. 154(b) by 972 days.

(21) Appl. No.: 12/710,952

(22) Filed: Feb. 23, 2010

(65) Prior Publication Data

US 2011/0204007 A1 Aug. 25, 2011

(51) Int. Cl.

| | |
|---|---|
| ***A47F 5/01*** | (2006.01) |
| ***A47F 7/14*** | (2006.01) |
| ***A47F 5/08*** | (2006.01) |
| *A47F 7/00* | (2006.01) |
| *B42F 15/06* | (2006.01) |
| *A47B 55/02* | (2006.01) |
| *A47F 7/16* | (2006.01) |

(52) U.S. Cl.

CPC ..... *A47F 7/148* (2013.01); *B42F 15/06* (2013.01); *A47F 7/143* (2013.01); *A47B 55/02* (2013.01); *A47F 7/163* (2013.01); *A47F 5/01* (2013.01); *A47F 5/0823* (2013.01)

(58) Field of Classification Search

CPC ..... A47F 7/148; A47F 5/01; A47F 5/0823; A47F 7/163; A47F 7/143; B42F 15/106; A47B 55/02

USPC ..... 211/59.2, 88.01, 90.01, 90.03, 134, 211/186, 187, 106, 181.1, 50, 45, 128.1, 211/126.8, 88, 126, 55, 52, 51, 54.1, 188, 211/126.1, 126.11, 49.1

See application file for complete search history.

(56) References Cited

U.S. PATENT DOCUMENTS

| | | | | | |
|---|---|---|---|---|---|
| 1,907,917 | A | * | 5/1933 | White | 248/27.8 |
| D162,990 | S | * | 4/1951 | Roeder | D6/463 |
| 2,793,760 | A | * | 5/1957 | Zel et al. | 211/55 |
| 2,891,677 | A | * | 6/1959 | Ritchie | 211/59.2 |
| D186,254 | S | * | 9/1959 | Tirlet | D6/464 |
| 3,043,439 | A | * | 7/1962 | Poillevey | 108/32 |
| 3,082,879 | A | * | 3/1963 | Wilson | 211/126.8 |
| 3,115,252 | A | * | 12/1963 | Scnical | 211/55 |
| 3,137,251 | A | * | 6/1964 | Pendergrast, Jr. | 108/110 |
| 3,232,442 | A | * | 2/1966 | Wilson | 211/133.2 |
| 3,288,303 | A | * | 11/1966 | Dahl | 211/51 |
| 3,294,351 | A | * | 12/1966 | Rollins, Jr. | 248/243 |
| 3,501,015 | A | * | 3/1970 | Behles | 211/49.1 |
| 3,524,565 | A | * | 8/1970 | Wilson | 220/491 |
| 3,709,576 | A | * | 1/1973 | Lemoine | 312/321.5 |
| 3,730,108 | A | * | 5/1973 | Stroh | 108/108 |
| 3,915,097 | A | * | 10/1975 | Young, Jr. | 108/6 |

(Continued)

*Primary Examiner* — Joshua J Michener
*Assistant Examiner* — Devin Barnett
(74) *Attorney, Agent, or Firm* — Belles Katz LLC

(57) ABSTRACT

A modular rack system for displaying flat articles. In one aspect, the invention comprises: a plurality of racks, each rack comprising: a floor for supporting a flat article, the floor having a front, a rear and lateral sides; a front retaining portion extending upward from the floor at the front of the floor; first and second lateral retaining portions extending upward from the floor along the lateral sides of the floor; at least two support members extending from the rear of the floor that engage a vertical wall and support the rack in a cantilevered manner and oriented so that the floor slopes downward and away from the vertical wall; and the racks mounted to the vertical wall in a stacked assembly so that an upper rack in the stacked assembly rests atop the first and second lateral retaining portions of a lower adjacent rack in the stacked assembly.

16 Claims, 14 Drawing Sheets

(56) References Cited

U.S. PATENT DOCUMENTS

| | | | | | |
|---|---|---|---|---|---|
| 3,978,799 | A | * | 9/1976 | Escalette | 108/28 |
| 3,993,002 | A | * | 11/1976 | Stroh | 108/108 |
| 4,119,207 | A | * | 10/1978 | Fuller et al. | 211/45 |
| 4,197,950 | A | * | 4/1980 | Ovitz, III | 211/134 |
| 4,248,352 | A | * | 2/1981 | White | 211/88.01 |
| 4,331,245 | A | * | 5/1982 | Schell | 211/45 |
| 4,343,405 | A | * | 8/1982 | Virte et al. | 211/88.01 |
| 4,511,047 | A | * | 4/1985 | Elinsky | 211/90.03 |
| 4,604,061 | A | * | 8/1986 | Willcocks et al. | 434/74 |
| 4,694,966 | A | * | 9/1987 | Sorenson et al. | 211/88.01 |
| 4,762,235 | A | * | 8/1988 | Howard et al. | 211/59.3 |
| 4,813,535 | A | * | 3/1989 | Radocha et al. | 206/738 |
| 4,930,640 | A | * | 6/1990 | Edwards | 211/134 |
| 5,031,781 | A | * | 7/1991 | Price et al. | 211/45 |
| 5,031,783 | A | | 7/1991 | Goudreau | |
| 5,160,051 | A | * | 11/1992 | Bustos | 211/59.2 |
| 5,184,737 | A | * | 2/1993 | Hardy | 211/55 |
| 5,284,257 | A | | 2/1994 | Schum | |
| 5,397,087 | A | * | 3/1995 | Teece | 248/220.42 |
| 5,439,122 | A | * | 8/1995 | Ramsay | 211/187 |
| 5,607,068 | A | * | 3/1997 | Coretti et al. | 211/59.2 |
| 5,685,439 | A | | 11/1997 | Luenser | |
| 5,836,459 | A | * | 11/1998 | Nezwek et al. | 211/50 |
| 6,079,574 | A | * | 6/2000 | Mylander et al. | 211/106 |
| 6,089,387 | A | * | 7/2000 | Varfolomeeva | 211/181.1 |
| 6,092,674 | A | * | 7/2000 | Rothstein et al. | 211/59.1 |
| 6,164,462 | A | * | 12/2000 | Mumford | 211/59.2 |
| 6,170,674 | B1 | * | 1/2001 | Caterinacci | 211/41.1 |
| D442,002 | S | * | 5/2001 | Rodack | D6/566 |
| 6,431,375 | B2 | * | 8/2002 | Spencer | 211/106 |
| D473,073 | S | * | 4/2003 | Kettering et al. | D6/509 |
| 7,118,000 | B2 | | 10/2006 | Shea | |
| 7,128,221 | B2 | * | 10/2006 | Metcalf | 211/59.2 |
| 7,147,114 | B2 | * | 12/2006 | Sarnoff et al. | 211/90.03 |
| 7,188,740 | B2 | * | 3/2007 | Marchetta et al. | 211/106 |
| 7,246,711 | B1 | * | 7/2007 | Metcalf | 211/175 |
| D547,955 | S | * | 8/2007 | Johnson et al. | D6/566 |
| 7,334,692 | B2 | | 2/2008 | Black | |
| 7,374,052 | B2 | * | 5/2008 | Price et al. | 211/86.01 |
| 7,806,283 | B2 | * | 10/2010 | Metcalf | 211/175 |
| 8,083,077 | B2 | * | 12/2011 | Wade et al. | 211/45 |
| 8,286,808 | B1 | * | 10/2012 | Setlik | 211/96 |
| 2002/0008074 | A1 | * | 1/2002 | Spencer | 211/49.1 |
| 2002/0033373 | A1 | * | 3/2002 | Robertson | 211/59.2 |
| 2002/0060198 | A1 | * | 5/2002 | Bustos | 211/187 |
| 2003/0000905 | A1 | * | 1/2003 | Zidek | 211/205 |
| 2003/0066811 | A1 | * | 4/2003 | Dimattio et al. | 211/59.2 |
| 2003/0146177 | A1 | * | 8/2003 | Miller et al. | 211/59.2 |
| 2004/0011752 | A1 | * | 1/2004 | Zadak | 211/90.03 |
| 2005/0092701 | A1 | * | 5/2005 | Metcalf | 211/59.2 |
| 2007/0295681 | A1 | * | 12/2007 | Colin | 211/90.03 |
| 2008/0142463 | A1 | | 6/2008 | Johnson | |
| 2010/0181267 | A1 | * | 7/2010 | Theisen | 211/45 |
| 2010/0288714 | A1 | * | 11/2010 | Kozak et al. | 211/59.2 |
| 2011/0204007 | A1 | * | 8/2011 | Golden et al. | 211/41.1 |
| 2011/0204008 | A1 | * | 8/2011 | Schulman | 211/55 |
| 2011/0278246 | A1 | * | 11/2011 | Daily | 211/59.2 |

* cited by examiner

MODULAR RACK SYSTEM FOR DISPLAYING FLAT ARTICLES

FIELD OF THE INVENTION

The present invention relates generally to modular rack systems, and specifically to modular rack systems for displaying flat articles, such as paper board products, in an angled orientation.

BACKGROUND OF THE INVENTION

Paper board products, such as posterboard, present unique issues that must be taken into consideration for retail display. As a threshold matter, posterboard has a very large surface area and is very thin, thus making it highly susceptible to permanent damage resulting from bending. Moreover, the flimsy nature of posterboard presents an additional problem with respect to handling. Finally, despite the lightweight nature of a single piece of posterboard, a stack of posterboard is quite heavy.

White posterboard is by far the most often used and, thus, the most purchased color of posterboard. Thus, white posterboard must be kept in stock in much greater quantities than all other colors. Nonetheless, retailers desire to carry and display every color of posterboard available in their inventory.

All of these considerations must be balanced against the fact that the maximization of shelf space in retailer stores is a fundamental consideration in whether to carry an item. Thus, many retailers do not like to carry posterboard in a wide variety of colors (or at all) due to the fact that a posterboard display takes up a large amount of shelf space.

Existing racks for displaying posterboards are stand-alone structures that have a set number of angled shelves. While the angled nature of the shelves reduces the depth of existing posterboard racks, they are limited in that the width and height of the posterboard racks are fixed dimensions. To this end, typical posterboard racks often do not fit on most aisle shelving systems and, thus, are limited to being positioned at "end-of-the-aisle" locations within retail stores. "End-of-the aisle" is the most desirous location for product placement within stores and, thus, is typically saved for high volume and/or high profit-margin items. Therefore, many stores choose to not carry (or carry limited amounts) of posterboard.

Moreover, even in those stores that have made room for posterboard displays, the closely stacked and angled nature of the shelves of existing posterboard racks make it very difficult for people to insert posterboard into the shelves, either during initial inventory placement or customer replacement. This problem is further exacerbated by the wire frame nature of the existing posterboard racks as the posterboard tends to get snagged on the wires during loading/unloading procedures. All of these issues result in damaged inventory, which is undesirable for obvious reasons.

Another issue with existing racks is that they have a static depth and, thus, can not be positioned atop decks having different depths.

In view of the above, a need exists for an improved rack system for supporting and displaying flat articles, such as paper board products, including posterboard.

SUMMARY OF THE INVENTION

The present invention is directed to a modular rack system for displaying flat articles, such as paper board products, foam board, bristle board and corrugated board.

In one aspect, the invention can be a modular racking system comprising: a plurality of racks, each rack comprising: a floor for supporting a flat article, the floor having a front, a rear and lateral sides; a front retaining portion extending upward from the floor at the front of the floor; first and second lateral retaining portions extending upward from the floor along the lateral sides of the floor; at least two support members extending from the rear of the floor that engage a vertical wall and support the rack in a cantilevered manner and oriented so that the floor slopes downward and away from the vertical wall; and the racks mounted to the vertical wall in a stacked assembly so that an upper rack in the stacked assembly rests atop the first and second lateral retaining portions of a lower adjacent rack in the stacked assembly.

In another aspect, the invention can be a modular rack system comprising: a wire frame rack having a floor, a front wall and lateral walls that collectively define a product retaining space for flat articles; the wire frame rack oriented so that the floor slopes downward from a rear of the floor to the front wall; and the lateral walls comprising elongated channels having open front ends that are offset a distance from the front wall.

In yet another aspect, the invention can be a paper board product display comprising: a plurality of racks, each of the racks comprising a floor, a front retaining portion extending upward from the floor, and lateral retaining portions extending upward from the floor that collectively defining a space for holding paper board product, the floor being oriented at an acute angle relative to a vertical wall; the racks arranged in a stacked assembly so that an upper rack in the stacked assembly rests atop the lateral retaining portions of a lower adjacent rack in the stacked assembly; wherein a lower-most rack in the stacked assembly comprises a base that rests atop and is supported by a horizontal surface; wherein the remaining racks in the stacked assembly are mounted to the vertical wall and supported in a cantilevered manner; and one or more paper board products positioned within the spaces and lying substantially flat atop the floors of the racks, the one or more paper board products retained within the spaces by the front retaining portions and the lateral retaining portions.

In yet another aspect, the invention can be a paper board product display comprising: a plurality of racks, each of the racks comprising a floor, a front retaining portion extending upward from the floor, and lateral retaining portions extending upward from the floor that collectively defining a space for holding paper board product, the floor being oriented at an acute angle relative to a vertical wall; the racks arranged in a stacked assembly so that an upper rack in the stacked assembly rests atop the lateral retaining portions of a lower adjacent rack in the stacked assembly; wherein a front edge of the lower-most rack in the stacked assembly rests atop and is supported by a horizontal surface; wherein the remaining racks in the stacked assembly are mounted to the vertical wall and supported in a cantilevered manner; and one or more paper board products positioned within the spaces and lying substantially flat atop the floors of the racks, the one or more paper board products retained within the spaces by the front retaining portions and the lateral retaining portions.

In still another aspect, the invention is a method of displaying paper board products comprising: a) providing a first and second rack, each of the first and second racks comprising a floor, a front retaining portion extending upward from the floor, and lateral retaining portions extending upward from the floor that collectively define a space for holding paper board product, the floor being oriented at an acute angle relative to a vertical wall; b) mounting the first and second racks to a vertical wall in a cantilevered manner and oriented so that the floors of the first and second racks slope downward and away from the vertical wall, the first and second racks arranged in stacked assembly so that the first rack rests atop the lateral retaining portions of the second rack; and c) sliding paper board products into the spaces of the first and second racks.

In a preferred embodiment, the invention is a method of displaying paper board products wherein the vertical wall is a pegboard wall and step b) comprises sliding support members of the first and second racks into holes of the pegboard wall, the first and second racks being self-supported by the interaction between the support members and the pegboard wall.

In another preferred embodiment, the invention is a method of displaying paper board products wherein the first and second racks are wire frame racks and the lateral walls comprise a U-channel tubular member comprising a floor plate, a roof plate and a wall plate connecting the floor plate and the roof plate, and wherein step c) comprises sliding the paper board products into the spaces of the first and second racks so that peripheral edge portions of the paper board products nest within the U-channel tubular members of the first and second racks.

In a further preferred embodiment, the invention is a method of displaying paper board products wherein each of the first and second racks further comprise first and second alignment portions extending downward from the floors, and wherein the lateral walls of the second rack nest within the first and second alignment portions of the first rack in the stacked assembly; and wherein the first and second racks in the stacked assembly remain separable from one another.

In a further aspect, the invention is a method of displaying paper board products comprising: a) positioning a base rack atop a horizontal surface and adjacent a vertical wall, the base rack comprising a floor, a front retaining portion extending upward from the floor, and lateral retaining portions extending upward from the floor that collectively defining a space for holding paper board products, the floor being oriented at an acute angle relative to a vertical wall; b) mounting a first rack to the vertical wall above the base rack, the first rack comprising a floor, a front retaining portion extending upward from the floor, and lateral retaining portions extending, upward from the floor of the first rack that collectively defining a space for holding paper board products, the floor of the first rack being oriented at the acute angle relative to the vertical wall, and wherein the floor of the first rack rests atop the lateral walls of the base rack; and c) sliding paper board products into the spaces of the base and first racks.

DETAILED DESCRIPTION OF THE INVENTION

Figure 1:
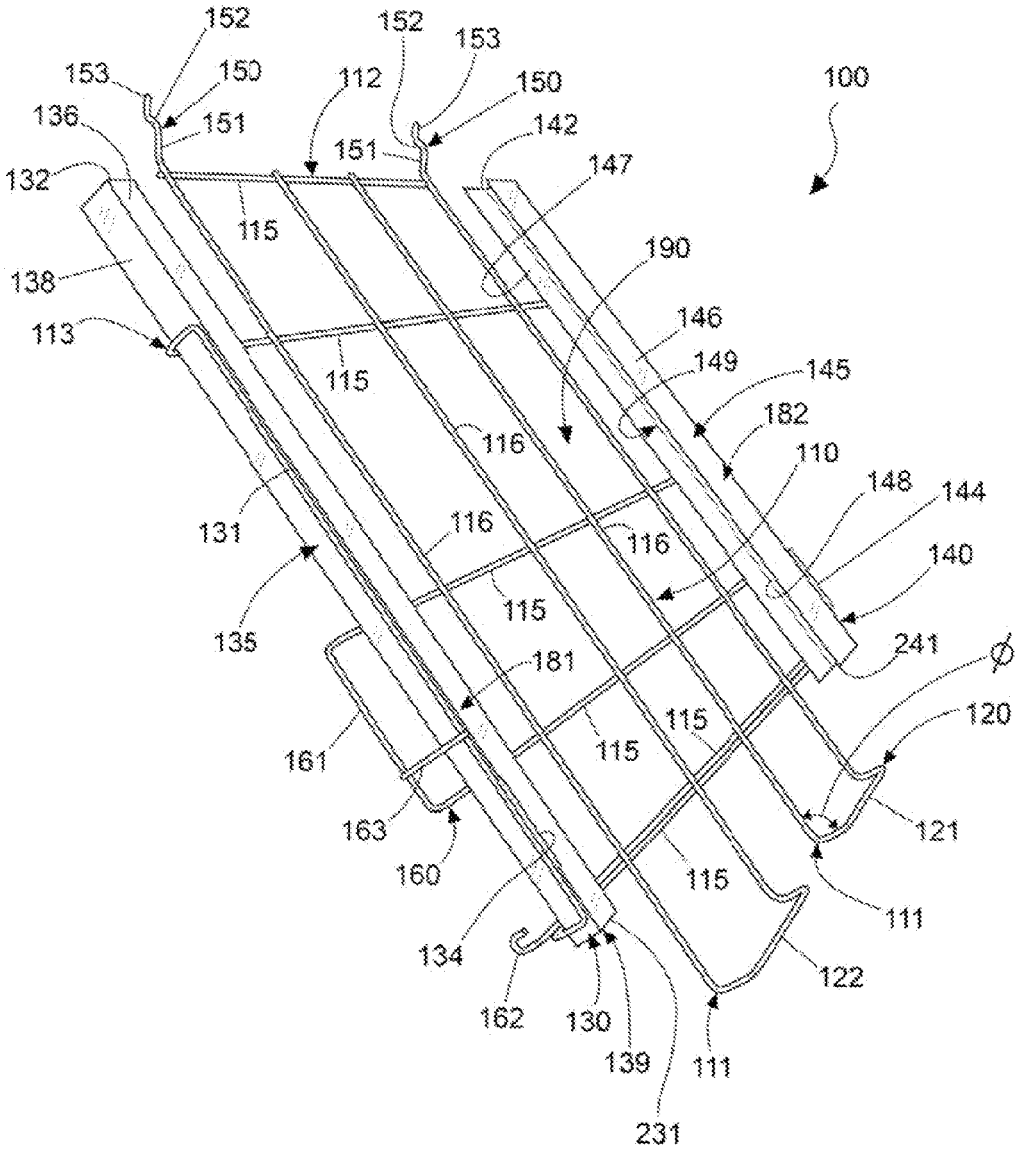
FIG. 1 is a perspective view of a rack according to an embodiment of the present invention.
Figure 2:
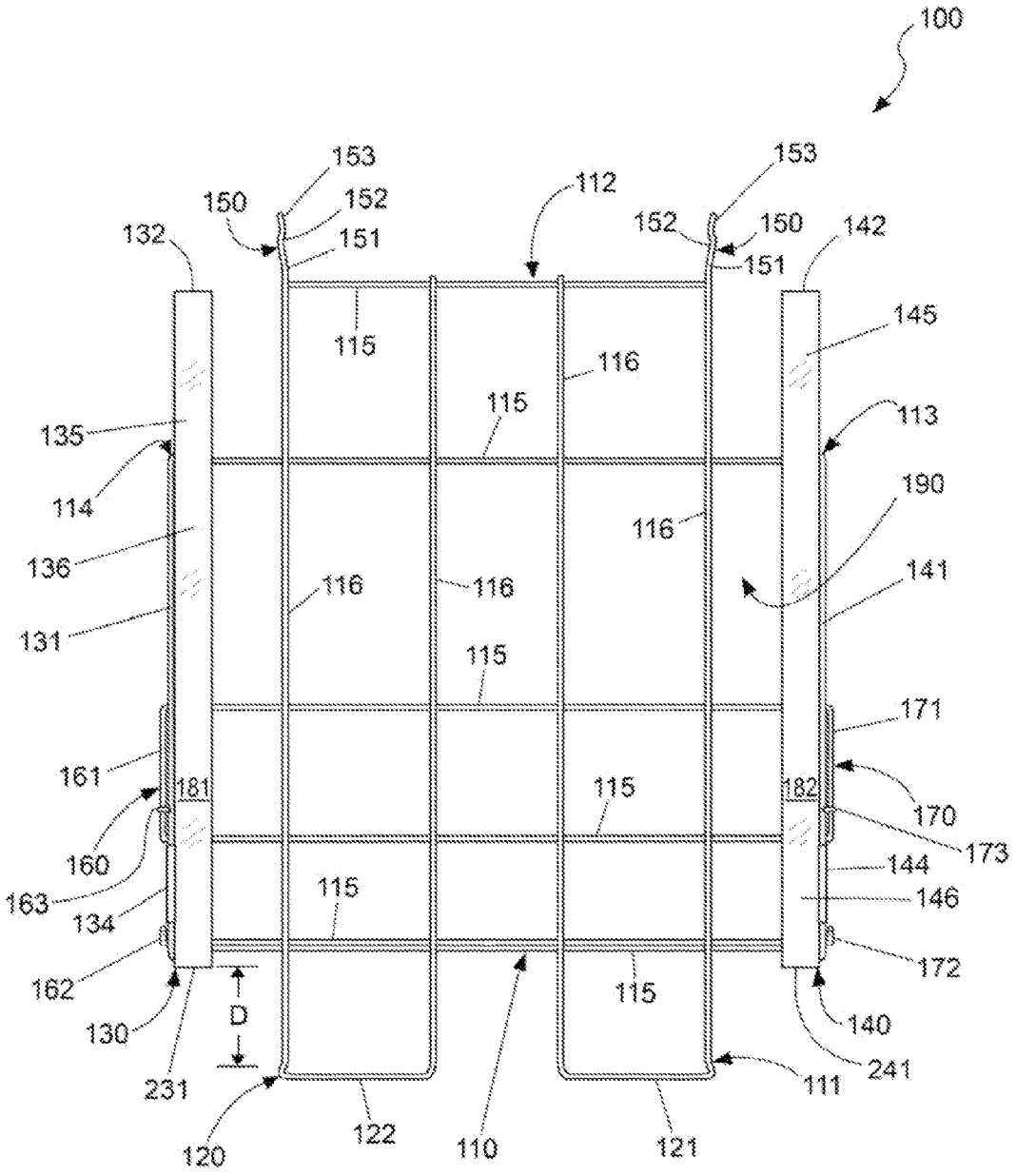
FIG. 2 is a top view of the rack of FIG. 1.
Figure 3:
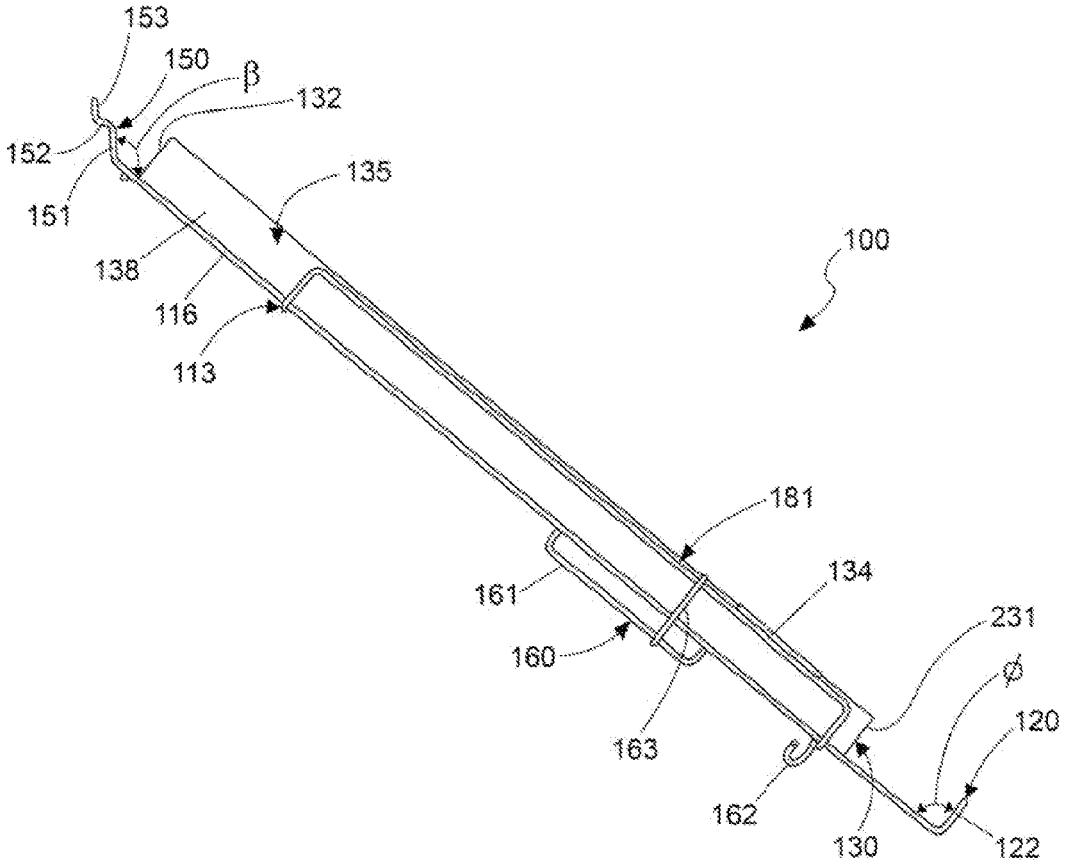
FIG. 3 is a left side-view of the rack of FIG. 1.

Referring to FIGS. 1-3 concurrently, a rack 100 according to an embodiment of the present invention is illustrated. The rack 100 is particularly suited for retaining and displaying stacks of flat flexible articles, such as paper board products. As used herein, paper board products include, without limitation, matte board, posterboard, packaging blanks, foam board, rigid paperboard, bristle board, corrugated board, and other flat paper products. While the invention will be discussed in detail below with respect to posterboard, the invention is not so limited in all aspects. In certain aspects, the invention will be directed to the rack 100 itself without regard to the products with which it is to be used in conjunction.

The rack 100 is a wire-frame rack having two U-channel tubes 135, 145 connected thereto. While a specific arrangement of wires is illustrated to create the frame of the rack 100, those skilled in the art will understand that a wide variety of frame configurations can be used to create the rack 100. Furthermore, the exact gauge of the wire used to create the frame of the rack 100 will be dictated on a case-by-case basis, taking into consideration such factors as desired loading requirements, size of the frame, number and configuration of the wires, rack manufacturing costs, and safety factors. Finally, it is to be understood that while a wire-frame structure is preferred to create the rack 100 due to the resulting lightweight and ease of handling, the invention is not so limited. In other embodiments, the rack 100 may be a plate structure or a combination of plates, wires and/or structural beams.

The rack 100 generally comprises a floor 110, a front retaining portion 120, a left lateral retaining portion 130, a right lateral retaining portion 140, support members 150, a left alignment portion 160, and a right alignment portion 170. As discussed in greater detail below, the floor 110, the front retaining portion 120, the left lateral retaining portion 130, and the right lateral retaining portion 140 collectively form a space/volume 190 for receiving and retaining flat articles, such as posterboard.

The floor 110 is constructed of a first plurality of linear wires 115 and a second plurality of linear wires 116. The linear wires 115 are arranged substantially parallel to one another and in a spaced-apart arrangement. Similarly, the linear wires 116 are arranged substantially parallel to one another and in a spaced-apart, arrangement. The first plurality of liner wires 115 and the second plurality of linear wires 116 are arranged in a rectilinear and intersecting manner so as to form the floor 110. Depending on the loading requirements, one or more of the wires 115, 116 may be "doubled-up" to provide additional rigidity and structural integrity to the rack 100. Moreover, additional linear wires 115, 116 can be incorporated into the floor 110 as necessary. Finally, while the wires 115, 116 are exemplified as linear segments, in other embodiments one or more of the wires 115, 116 can be curved and/or angled in nature.

The floor 110 defines a planar surface on which posterboard or other flat articles can lay flat. The floor 110 comprises a front 111, a rear 112, and left and right lateral sides 113, 114 that conceptually define the periphery of the floor 110, which in the exemplified embodiment is rectangular. Of course, the floor 110 can take on other shapes. In the exemplified embodiment, the rear 112 is delimited by the uppermost wire 115 while the front 111 is delimited by the front ends of the wires 116 (at the upward bend) The left and right lateral sides 113, 114 are delimited by the ends of the wires 115 (at the upward bend).

In a preferred embodiment, the floor 110 is sized to accommodate a standard sized posterboard, which is typically 22 inches by 28 inches, with a tolerance of 1-3 inches or less. As exemplified, the length of the floor 110 (which extends from the front 111 to the rear 112) is between 28 to 31 inches while the width of the floor 110 (which extends from the left and right lateral sides 113, 114) is front 111 to the rear 112) is between 24 to 27 inches. Of course, the invention is not limited to any specific size in all embodiments. Moreover, as will be discussed in greater detail below, depending on the depth of the horizontal deck of the shelf to which the rack 100 will be installed, in certain embodiments of the invention it may be desirable to modify the width of the floor 110 to accommodate the larger dimension of the posterboard, thereby allowing the length of the floor 110 to be reduced to accommodate the smaller dimension of the posterboard. Thought of another way, in order to ensure that the rack 100 does not excessively protrude beyond the horizontal deck of the shelf, the rack 100 may be designed so that the distance between the front 111 and rear 112 of the floor 110 is less than the distance between the left and right lateral sides 113, 114 of the floor 110.

The front retaining portion 120 extends upward from the front 111 of the floor 110 and comprises a first U-shaped wire section 121 and a second U-shaped wire section 122. The front retaining portion 120 defines a front wall that retains and prohibits posterboard that is resting on the floor 110 from sliding off the front 111 of the floor 110, even when the rack 100 is in angled/sloped orientation (as shown in FIG. 1). While two U-shaped wire sections 121, 122 are used to create the front retaining portion 120 in the exemplified embodiment, the invention is not so limited and the front retaining portion 120 can be created by a wide variety of structural arrangements. For example, a single U-shaped wire section can be used to create the front retaining portion 110. Alternatively, a plurality of spaced apart linear wire segments that extend upward form the floor 110 can be used. In still other embodiments, the front retaining portion 120 can be formed from one or more plates extending upward from the floor 120.

In the exemplified embodiment, the front retaining portion 120 extends upward from the plane formed by the floor 110 in an angle Φ, which in the exemplified embodiment is a substantially normal angle (i.e., substantially 90 degrees). The invention, however, is not limited to any specific value for the angle Φ between the floor 110 and the front retaining portion 120 so long as the front retaining portion 120 can prohibit posterboard that is loaded within the rack 100 from sliding off the front 111 of the floor 110 when the rack 100 is mounted in the desired angled orientation.

Figure 13:
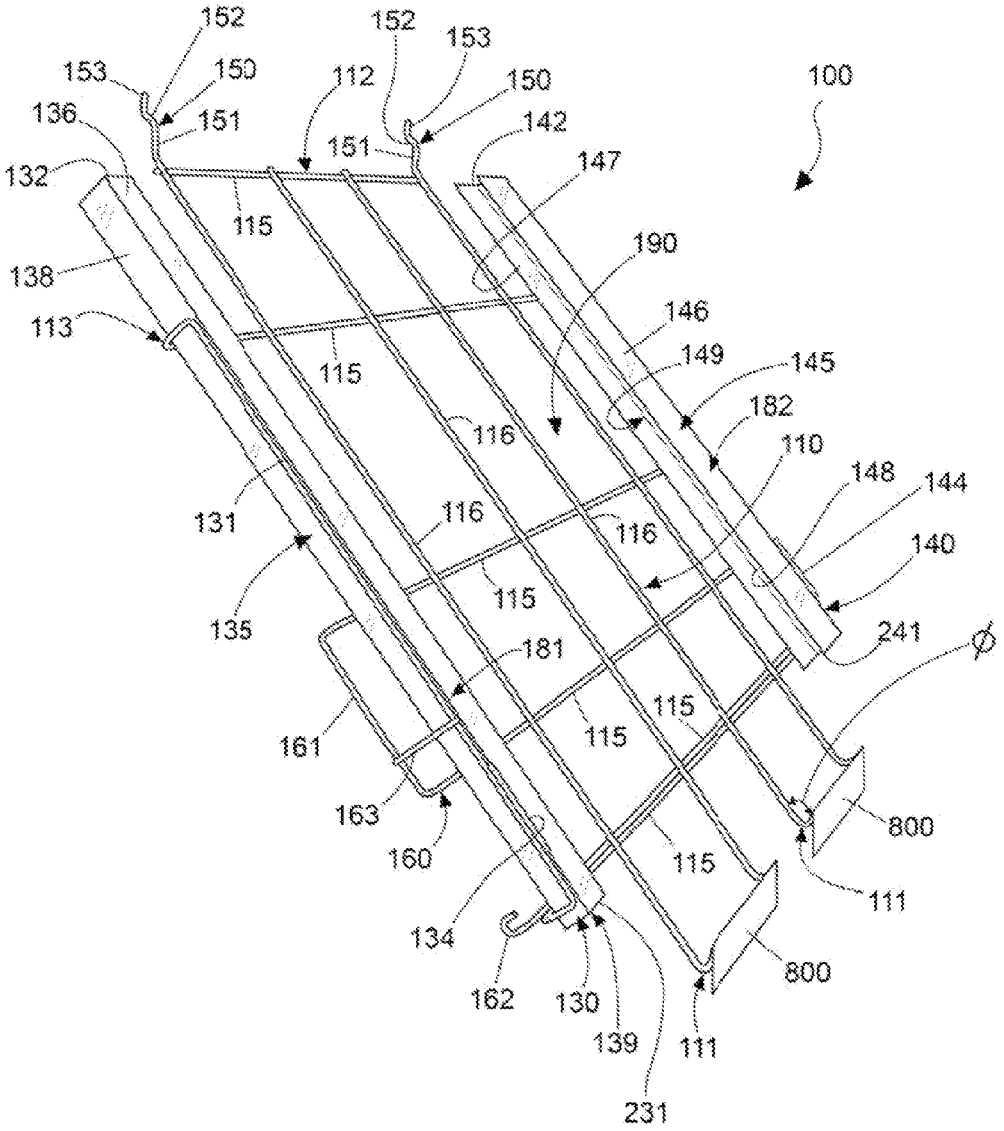
FIG. 13 is an isometric view a rack according to an alternative embodiment of the present invention wherein the front retaining portion is at an acute angle relative to the floor and product identification plates are included on the front retaining portion.
Figure 14:
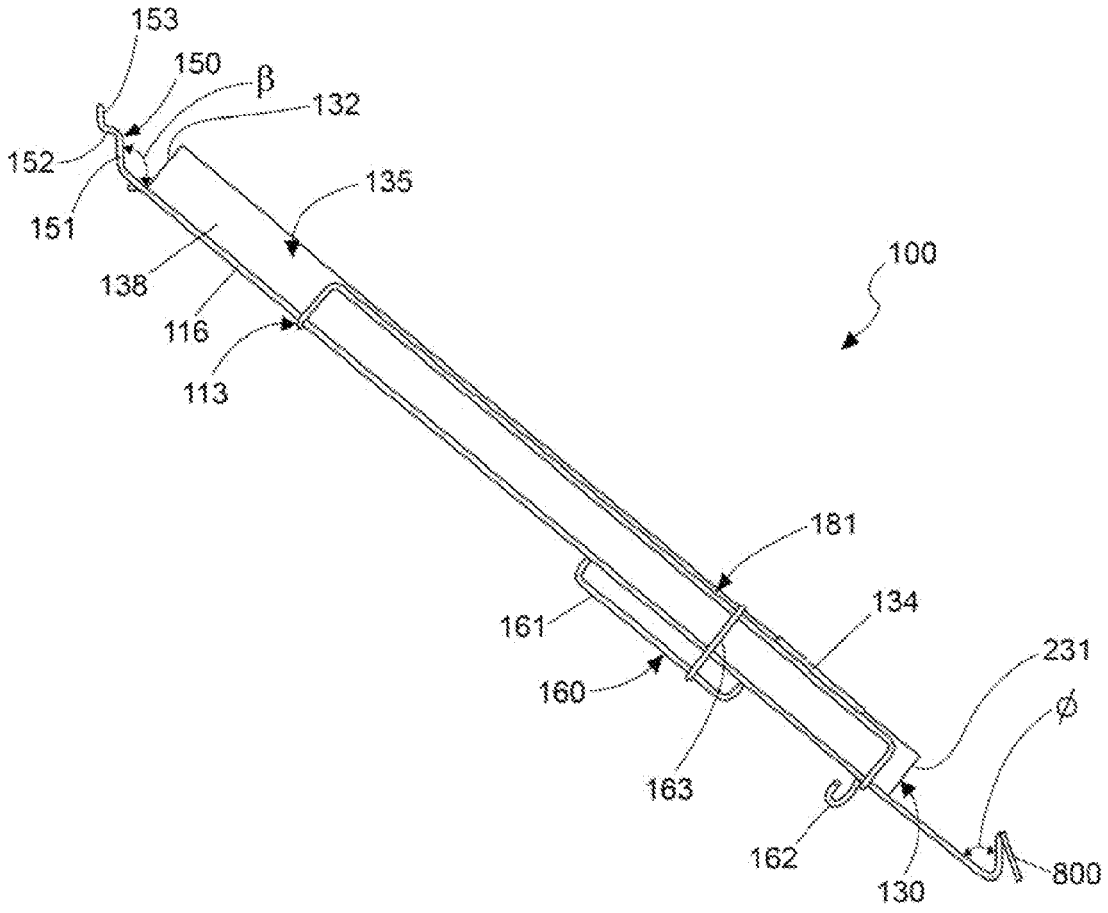
FIG. 14 is a side view of the rack of FIG. 13.

As illustrated in FIGS. 13-14, in certain embodiments of the invention, the front retaining portion 120 extends upward from the floor 110 at a non-normal angle. In one such embodiment, it is preferred that the front retaining portion 120 extend upward from the floor 110 so that angle Φ is an acute angle. As a result of orienting the front retaining portion 120 at the acute angle relative to the floor 110 as described above, when a stack of posterboard is loaded within the rack 100 and the rack is mounted in its angled/sloping orientation (FIG. 5), the edges of the adjacent posterboards in the stack become offset from one another because the edges of the posterboards rest against the inner surface of the front retaining portion 120, thereby creating a "fanned-effect." This increases visibility of the posterboards to the consumer.

Additionally, by having the angle Φ as an acute angle, the front retaining portion 120 can be used to effectively display product information for that rack 100. Thus, in one embodiment of the invention, the front retaining portion 120 may further comprise one or more display surfaces for displaying product information for the items retained in the rack 100. In the exemplified embodiment, the display surfaces may be provided by one or more plates 800 that are connected to the U-shaped wires 121, 122. In the preferred embodiment, the plates 800 are attached at an angle to the U-shaped wires 121, 122 so that the front surfaces of the plates 800 are tilted upward to increase consumer visibility. These plates 800 may contain a retaining area for holding a product information card.

In certain embodiments, the acute angle Φ is preferably in the range of 35 to 65 degrees, and more preferably 45 to 55 degrees. In a further preferred embodiment, the angle Φ substantially corresponds to the acute angle Θ at which the floor 110 is oriented relative to the wall 300 (discussed below with respect to FIGS. 5-6). In other embodiments the angle Φ is within 5 to 10 degrees of the acute angle Θ. The invention, of course, is not so limited in all embodiments.

The left and right lateral retaining portions 130, 140 extends upward from the lateral sides 113, 114 respectively. The left lateral retaining portion 130 generally comprises a U-shaped wire section 131 and U-channel 135. Similarly, the right lateral retaining portion 140 generally comprises a U-shaped wire section 141 and U-channel 145. It should be noted that in certain embodiments of the invention, the left and right lateral retaining portions 130, 140 can be formed out of just the U-channels 135, 145 or just the U-shaped wire sections 131, 141. Moreover, it is also possible to replace the U-shaped wire sections 131, 141 with plate structures, series of linear wire segments or combinations thereof. Stated simply, the left and right lateral retaining portions 130, 140 can be created by a wide variety of structural arrangements.

Each of the left and right lateral retaining portions 130, 140 define a lateral wall that retains and prohibits posterboard that is resting on the floor 110 from sliding off the lateral sides 113, 114 of the floor 110. Moreover, the U-channels 135, 145 act as guide members for posterboard that is being loaded and/or unloaded from the space 190, thereby greatly minimizing damage to the inventory. The U-shaped wire sections 131, 141 are integral with the linear wires 115 of the floor 110 and are bent so as to extend upward from the plane formed by the floor 110 at a substantially normal angle. The invention, however, is not limited to any particular angle, number or construction of the U-shaped wire sections 131, 141.

The U-channels 135, 145 are positioned within the rack 100 atop the floor 110 and adjacent the U-shaped wire sections 131, 141. The U-channels 135, 145 are preferably metal and can be secured to the floor 110 and/or the U-shaped wire sections 131, 141 through a number connection techniques known in the art, including without limitation welding, fastening, adhering, and/or compression. In other embodiments, the U-channels 135, 145 can be constructed of plastic, wood, cardboard, or combinations thereof. Of course, other materials can be used.

The U-channels 135, 145 are exemplified as plate structures, each comprising a roof plate 136, 146, a floor plate 137, 147, and a wall plate 138, 148. The wall plates 138, 148 connect the floor plates 137, 147 and the roof plates 136, 146 so as to form elongated channels 139, 149 therebetween. The channels 139, 149 have open transverse front ends 231, 241 and open transverse rear ends 132, 142 that allow the peripheral edge portions of posterboard to be slid into and through the channels 139, 149 during loading and/or unloading of the rack 100. Elongated longitudinal slots allow the peripheral edge portions of the posterboard to extend into and lay within the channels 139, 149 when a stack of posterboard is loaded into the space 190.

While the channels 139, 149 are formed by U-channel tubular members 135, 145, the channels 139, 149 can be formed by a variety of structures. For example, the channels 139, 149 can be formed by L-shaped brackets. Additionally, while each of the U-channels 135, 145 is exemplified as a single elongated structure, it is possible for the U-channels 135, 145 to be formed by spaced-apart and aligned segments. In one alternative embodiment, a single plate of material can be laid atop the floor 110 and have its lateral edges bent into either an L-shape or a U-shape to form the channels 139, 149. In other embodiments, the channels 139, 149 may have other transverse cross-sectional shapes.

The U-channel tubular members 135, 145 are positioned within the wire frame rack 100 so that the open front ends 231, 241 are offset a distance D from the front 111 of the floor 110 (and thus the front retaining portion 120). In one embodiment, the distance D is in a range of 6 to 8 inches, and most preferably is about 4 inches. This offset distance D provides a clearance that allows paperboard to be positioned above front retaining portion 120 and still be capable of being slid into the channels 139, 149. The offset distance D is even more important when the racks 100 are arranged in the stacked assembly 500 (FIG. 7) as the upper adjacent rack places a limit on the angle at which posterboard can be fed into the space 190.

The U-channel tubular members 135, 145 serve two primary purposes for the rack 100. First, as discussed above, the channels 139, 149 act as guide channels for the peripheral edge portions of the posterboard during loading and loading from space 190, thereby preventing the posterboard edges from getting snagged on the wire frame portions of the rack 100. Second, the U-channel tubular members 135, 145 provide structural rigidity to the rack 100 during posterboard loading conditions, thereby preventing sagging in the floor 110 of the rack 100.

Figure 4:
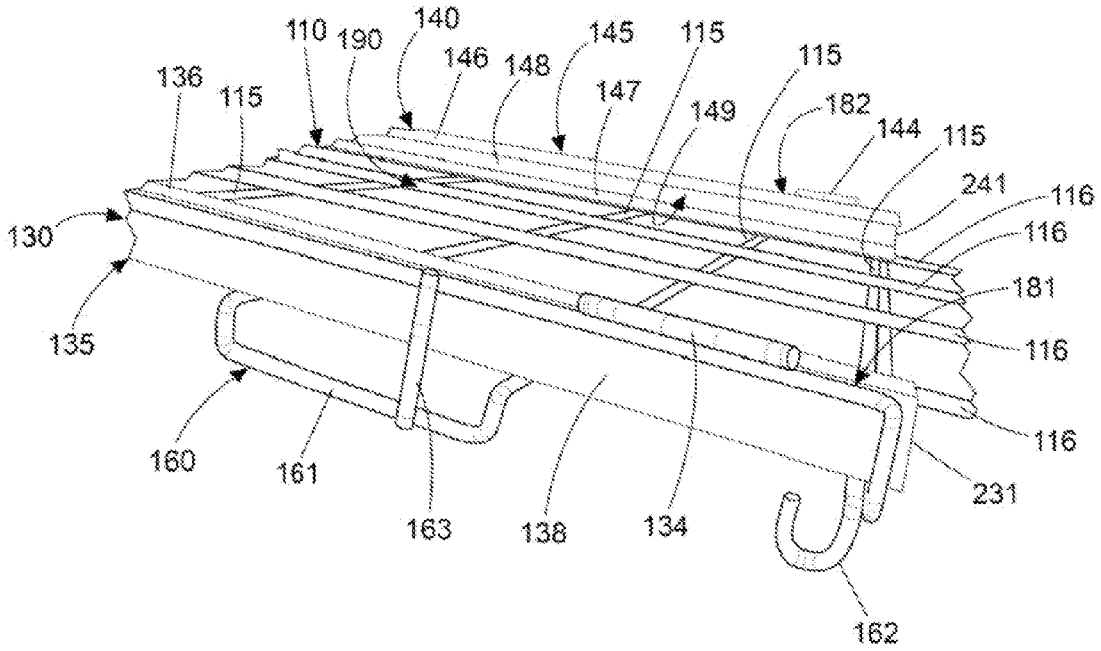
FIG. 4 is a close-up view of a front portion of the rack of FIG. 1.

Referring now to FIGS. 1 and 4 concurrently, each of the left and right lateral portions 130, 140 further comprise a protuberance 134, 144 protruding from the top surfaces 181, 182 of the left and right lateral portions 130, 140. In the exemplified embodiment, the protuberances 134, 144 are spacer bars, which are short rod-like segments of wire connected to the upper surfaces of the U-wire sections 131, 141. The protuberances 134, 144, however, can take on a wide variety of shapes and structures and can be located on the top surfaces of the U-channels 135, 145 if desired. The protuberances 134, 144 are located on a front section of the left and right lateral portions 130, 140 near the open front ends 231, 241 of the channels 239, 249. As will be described below in detail, when a plurality of the racks 100 are arranged in the stacked assembly 500, the protuberances 234, 244 provide a structure on which the front portion of the adjacent upper rack rests, thereby increasing the height of the opening into the space 90.

Referring now to FIGS. 1, 2 and 4 concurrently, the rack 100 further comprises left and right alignment portions 160, 170. The alignment portions 160, 170 each comprise a U-shaped wire 161, 171, a J-shaped wire 162, 172 and a reinforcement bar 163, 173 that couples a central portion of the U-shaped wire 161, 171 to the U-shaped wires 131, 142 of the lateral retaining portions 130, 140. Of course, in certain embodiments of the left and right alignment portions 160, 170, either the U-shaped wires 161, 171 or the J-shaped wires 162, 172 may be omitted. Moreover, either or both of these structures can take on other structural configurations as discussed above with respect to the front retaining portion 120 and/or the lateral retaining portions 130, 140. In one embodiment, the J-shaped wires 162, 172 can take on a U-shape, an L-shape or other combinations thereof.

The alignment portions 160, 170 are located along the lateral sides 113, 114 of the floor 110 below the lateral retaining portions 130, 140. However, unlike the front retaining portion 120 and the lateral retaining portions 130, 140, the alignment portions 160, 170 extend downward from the plane formed by the floor 110 rather than upward. In other words, the alignment portions 160, 170 extend from the floor 110 in a direction substantially opposite from the direction in which the front and lateral retaining portions 130, 140 extend from the floor 110.

As discussed in greater detail below, the alignment portions 160, 170 are provided to create a space therebetween in which a lower rack in the stacked assembly 500 can nest. In this capacity, the alignment portions 160, 170 ensure that the racks in the stacked assembly 500 are properly aligned during installation and further prohibit accidental lateral dislodgement thereafter.

The alignment portions 160, 170 preferably extend downward from the floor 110 at a substantially normal angle but can be oriented at other angles if desired. In one embodiment, it may be preferred to have the alignment portions 160, 170 angled downward from the floor and slightly away from a longitudinal center line of the rack 100, thereby creating a funnel-like effect for a lower adjacent rack when the stacked assembly 500 is created.

The inner surfaces of the alignment portions 160, 170 are preferably separated from each other by a distance that is at least equal to (and preferably slightly greater) than the distance between the outer surfaces of the lateral retaining portions 130, 140. This ensures that a lower adjacent rack in the stacked assembly can nest between the alignment portions 160, 170 of the adjacent upper rack, thereby allowing the floor 110 of the adjacent upper rack to rest atop the lateral retaining portions 130, 140 of the lower adjacent rack. Of course, in an alternative embodiment, the alignment portions 160, 170 may be constructed so as to be sufficiently flexible to accommodate the lower adjacent rack during stacking.

Referring now to FIGS. 1 and 3 concurrently, the rack 100 further comprises a pair of support members 150 extending from the rear 112 of the floor 110. While the exemplified embodiment of the rack 100 comprises two support members 150, any number of support members 150 can be used as necessary to support the desired loading. In one preferred embodiment, four support members 150 are incorporated into the rack 100, one support member 150 extending from each of the wires 116.

Each of the support members 150 comprise a first section 151, a second section 152, and a third section 153. The first section 151 is connected to the rear 112 of the floor 110 of the rack 100 and extends upward and away from the plane formed by the floor 110 at an obtuse angle β, which is preferably in a range of 105 to 135 degrees, and most preferably in a range of 115 to 125 degrees. The proximal end of the second section 152 is connected to a distal end of the first section 151. The second section 152 extends in a substantially normal angle to the first section 151. The proximal end of the third section 153 is connected to the distal end of the second section 152. The third section 153 extends in a substantially normal angle to the second section 152. The third section 153 is aligned in a substantially parallel and non-coaxial arrangement with respect to the first section 151. As exemplified, the support members 150 take on a flattened S-shape that can be used to slidably mount the rack 100 to a pegboard wall. However, in alternative embodiments, the support members 150 can take on other shapes that can facilitate slidable mounting, such as a J-hook or L-hook, the orientation of which is not limiting of the invention. Moreover, in certain embodiments where slidable mounting of the rack 100 is not desired, the support members can also be plates for receiving bolts, clips, fasteners, latches, or any other structures known in the art for mounting.

Figure 5:
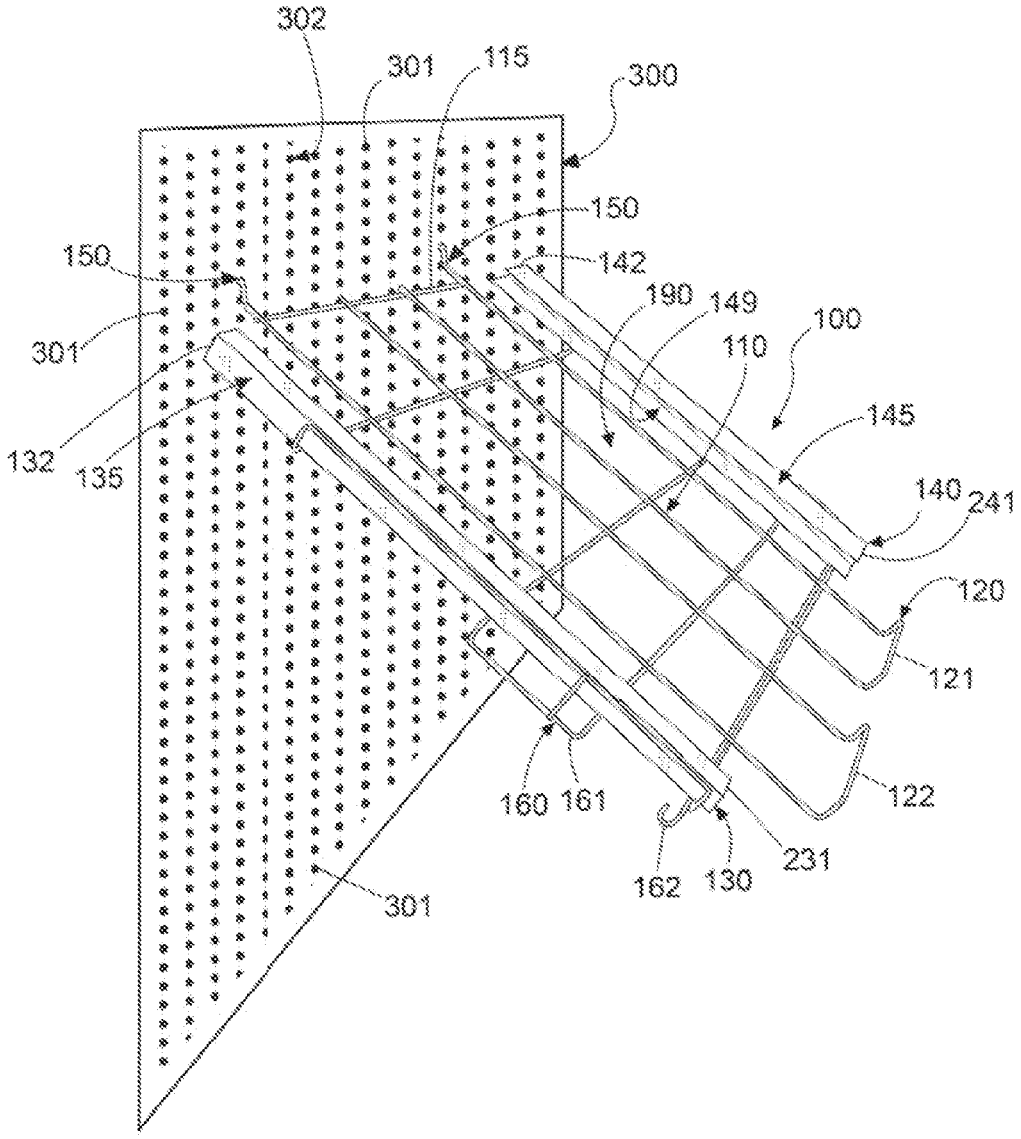
FIG. 5 is an isometric view of the rack of FIG. 1 mounted a vertical pegboard wall in a cantilevered manner according to an embodiment of the present invention.
Figure 6:
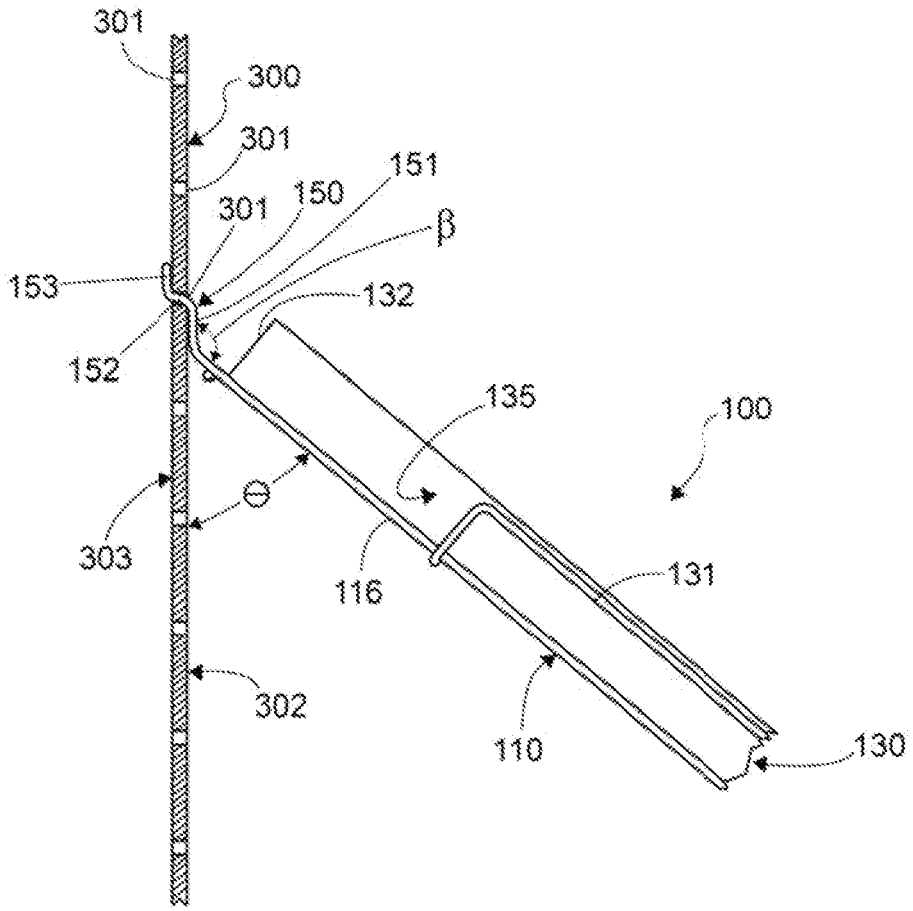
FIG. 6 is a side schematic view of FIG. 5 illustrating the cooperation of the rack to the vertical pegboard wall so that the rack is self-supporting.

Referring now to FIGS. 5 and 6 concurrently, the rack 100 is illustrated mounted to a vertical wall 300, which is in the form of a pegboard wall, according to an embodiment of the present invention. While a pegboard wall is exemplified, it is to be understood that the invention is not so limited and in other embodiments the vertical wall may be a slat wall, a grid wall, and combinations thereof. Of course, the support members 150 of the rack 100 will be modified appropriately to engage the exact type of wall with which the rack 100 is to be used.

In order to mount the rack 100 to the pegboard wall 300, the rack 100 is first positioned so that the distal ends of the third sections 153 of the two support members 150 are aligned with the desired holes 301 of the vertical wall 300. Once the rack 100 is properly aligned with the desired holes 301, the rack 100 is oriented so that the third sections 153 of the support members 150 can be slid into and through the holes 301. The rack 100 is then translated toward the wall 300 so that the third sections 153 of the support members 150 slidably insert into and through the holes 301 of the wall 300.

The front end of the rack 100 is then lowered, thereby causing the rack 100 to rotate about the contact points between second sections 152 of the support members 150 and the inside surfaces of the holes 301 of the wall 300. The is lowering continues until the first sections 151 of the support members 150 come into surface contact with the front surface 302 of the wall 300 while the third sections 153 of the support members 150 come into surface contact with the rear surface 303 of the wall 300. More specifically, the rear surface of the first sections 151 of the support members 150 come into surface contact with the front surface 302 of the wall 300 below the holes 301 while the front surface of the third sections 153 of the support members 150 come into surface contact with the rear surface 303 of the wall 300 above the holes 301. The weight of the rack 100 (and its load) create a downward moment about the second sections 152 of the support members 150 that prohibits the support members 150 (and the rack 100) from disengaging the vertical wall 300. Additional support is provided by the wire 115 that forms the rear 114 of the floor 110, which is also in contact with the wall 300.

When the rack is slidably mounted to the vertical wall 300 as described above, the rack 100 is mounted to the wall 300 in a cantilevered manner and is self-supporting. Moreover, as a result of the obtuse angle β between the first sections 151 of the support members 150 and the floor 110, the rack is in an angled/sloped orientation wherein an acute angle Θ is formed between the floor 110 (or the plane formed thereby) and the front surface 302 of the vertical wall 300. As can be seen, the floor 110 slopes downward and away from the vertical wall 300.

In certain embodiments, it is preferred that the acute angle Θ be in a range of 15 to 65 degrees. Most preferably, it has been discovered that the acute angle Θ should be in a range of 25 to 55 degrees so that the rack 100 does not protrude too far from the wall while still affording a customer the ability to load the rack 100 effectively. Of course, the invention is not limited to any specific range for the angle of orientation in certain embodiments.

While the mounting of the rack 100 to the vertical wall 300 is preferably a slidable mounting procedure, the racks 100 can be fixedly mounted to the wall 300 with fasteners, welding and/or latches according to alternative embodiments of the invention. Moreover, in certain alternative embodiments, the vertical wall 300 may include one or more vertical tracks (such as C-channels or the like) to which the rack 100 can be slidably mounted in the cantilevered manner and angled orientation. In such an embodiment, the support members 150 can be modified to take on the necessary shape and orientation to slidably engage the tracks.

It should also be noted that in certain embodiments of the invention, the first sections 151 of the support members 150 may not come into surface contact with the front surface 302 of the wall 300. This allows the angle Θ to be varied using the same structural rack 100. This allows this allows the same rack 100 to be used in conjunction with decks of different depths.

Figure 7:
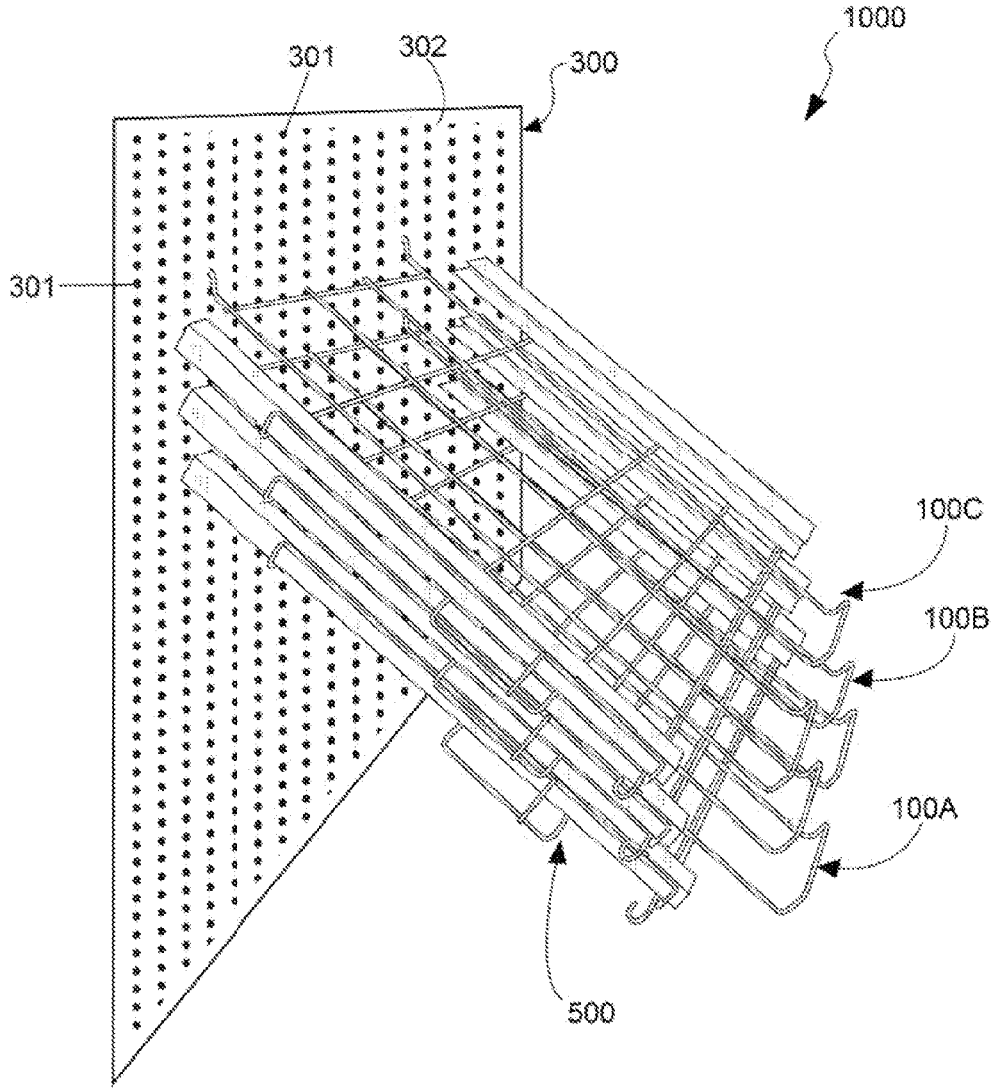
FIG. 7 is an isometric view of a rack system according to an embodiment of the present invention wherein a plurality of the racks of FIG. 1 are mounted to the vertical pegboard in a stacked assembly.

Referring now to FIG. 7, a modular rack system 1000 is illustrated according to an embodiment of the present invention. The modular rack system 1000 comprises a plurality of the racks 100A-C of FIGS. 1-6. While three racks 100A-C are illustrated in the system 1000, any number of racks can be utilized. As can be seen, the racks 100A-C are mounted to the wall 300 one above the other so as to form a vertically stacked assembly 500. Generally, each of the racks 100A-C is mounted to the vertical wall 300 as described above with respect to FIGS. 5-6, and in the order of rack 100A, followed by rack 100B, then followed by rack 100C. Stated simply, the stacked assembly 500 is formed from the bottom up. The holes 301 of the pegboard 300 to which the racks 100A-100B are inserted are in vertical alignment with one another and spaced so as to achieve the desired spacing between racks 100A-C.

When the racks 100A-C are mounted to the vertical wall 300 to form the stacked assembly 500, the individual racks 100A-C interact with one another to create a robust and stable structure, while still allowing the addition or removal of racks with ease to meet inventory needs. The interaction between two adjacent racks 100A, 100B in the stacked assembly will now be described with respect to FIG. 8 with the understanding that the discussion is applicable to any two adjacent racks in the stacked assembly 500.

Figure 8:
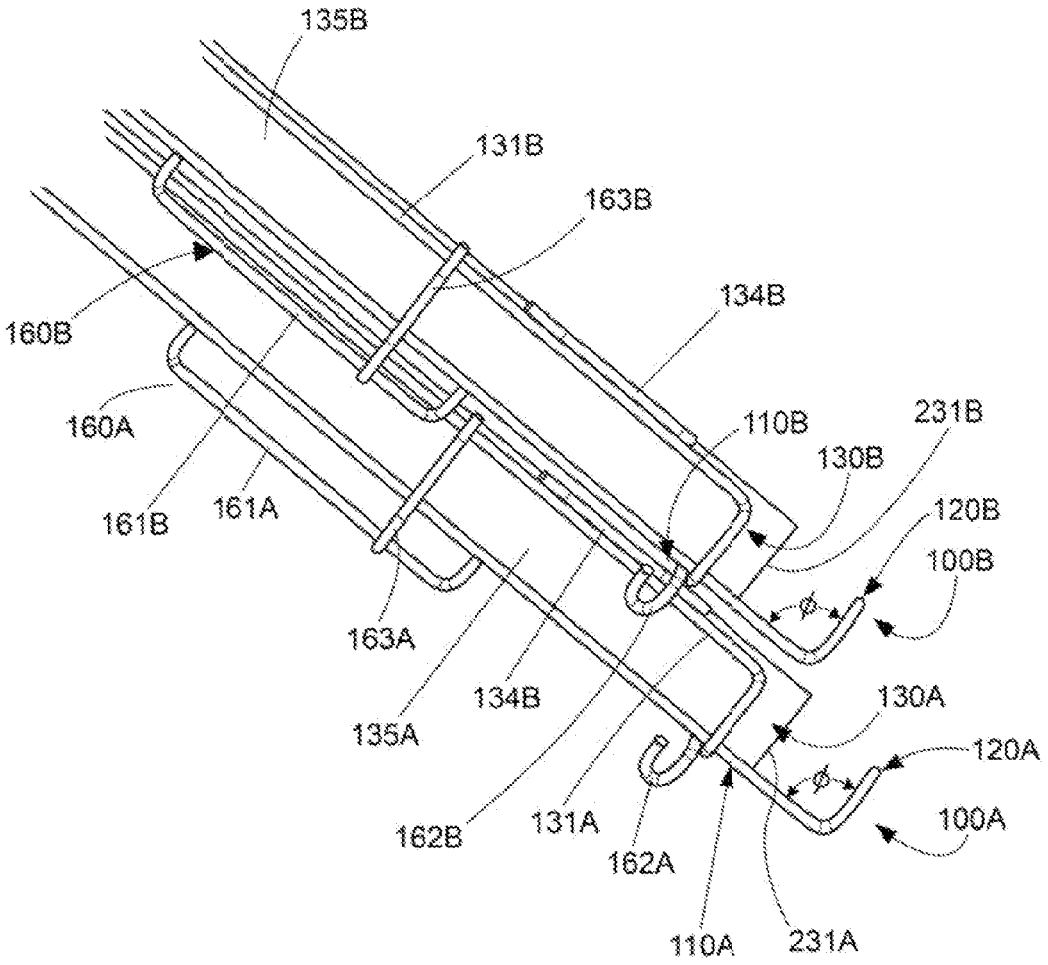
FIG. 8 is a close-up left side view of the interface between adjacent racks in the stacked assembly of FIG. 7.

Referring now to FIG. 8, the interaction of the racks 100A, 100B in the stacked assembly 500 will be described. As illustrated, rack 100A is the lower adjacent rack in the stacked assembly 500 while the rack 100B is the upper adjacent rack in the stacked assembly 500.

The rack 100A is first slidably mounted to the wall 300 as discussed above with respect to FIGS. 5-6. The rack 100B is then slidably mounted to the vertical wall 300 at a position above the rack 100A in the same manner. When the front end of the rack 100B is lowered so that the rack 100B is in the desired angled orientation, its support members 150B engage the wall 300. At this point, the floor 100B of the rack 100B is in surface contact with and rests atop the lateral retaining portions 130A, 140A of the rack 100A. More specifically, in the exemplified embodiment, the front portion of the floor 1008 of rack 100B rests atop and contacts the protuberances 134A, 144A of the lateral retaining portions 130A, 140A of the rack 100A.

It should be noted, however, that for safety purposes, it may be desirable that a small space exist between the rack 100B and the rack 100A when the racks 100A, 100B are mounted but not loaded to ensure that the racks 100A, 100B are securely mounted to the wall 300. In this case, when the rack 100B is loaded with posterboard, the rack 100B will deflect downward, resulting in the floor 100B of the rack 100B to come into contact with the lateral retaining portions 130A, 140A of the rack 100A.

Also at this point, the alignment portions 160B, 170B of the rack 100B extend adjacent to the outer surfaces of the lateral retaining portions 130A, 140A of the rack 100A. Thought of another way, the lateral retaining portions 130A, 140A of the rack 100A nest within the space formed between the alignment portions 160B, 170B of the rack 100B.

Finally, when the stacked assembly 500 is formed, the front-most edges 199A-B of the racks 100A-B are aligned in a substantially vertical plane. In certain embodiments, the protuberances 134A, 144A may be separable components from the racks 100A-B or additional spacing members or structures may be used between adjacent racks 100A-B in the stacked assembly 500 to effectuate the surface contact between the floors and the lateral retaining portions.

Figure 9:
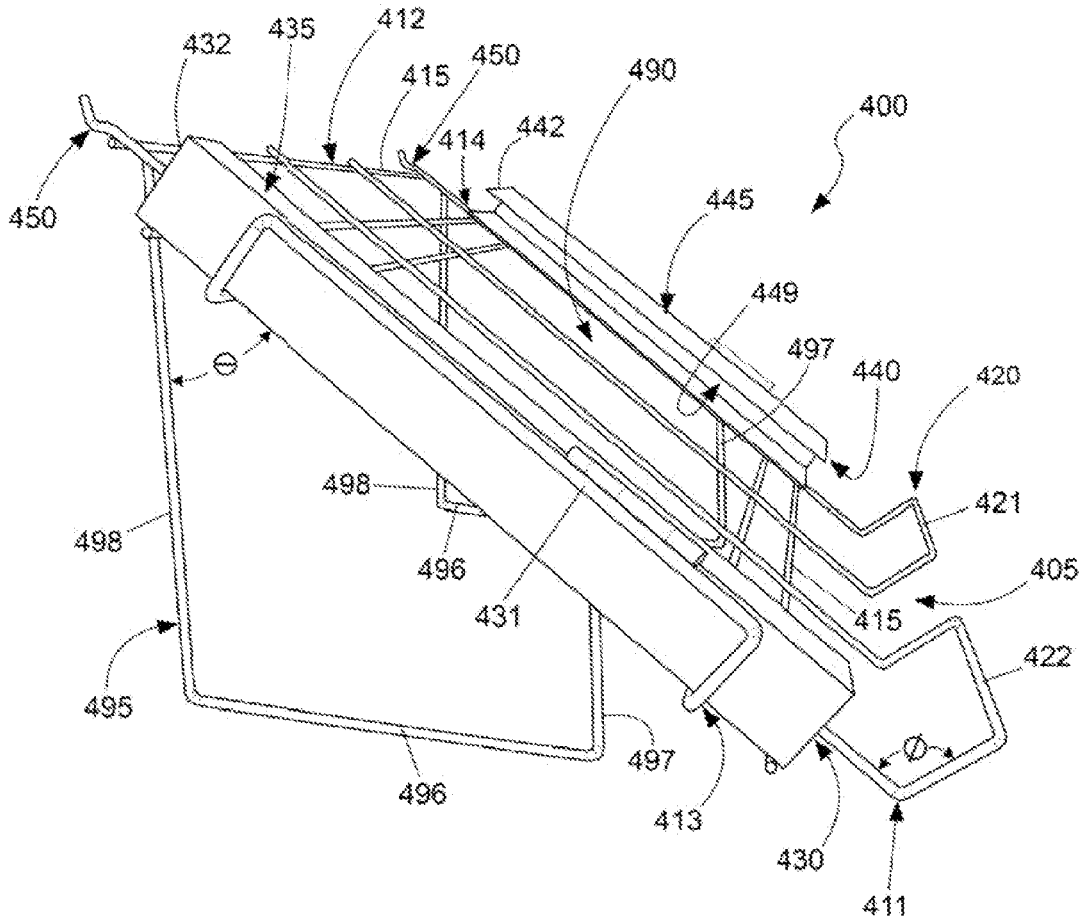
FIG. 9 is a base rack according to an embodiment of the present invention.
Figure 10:
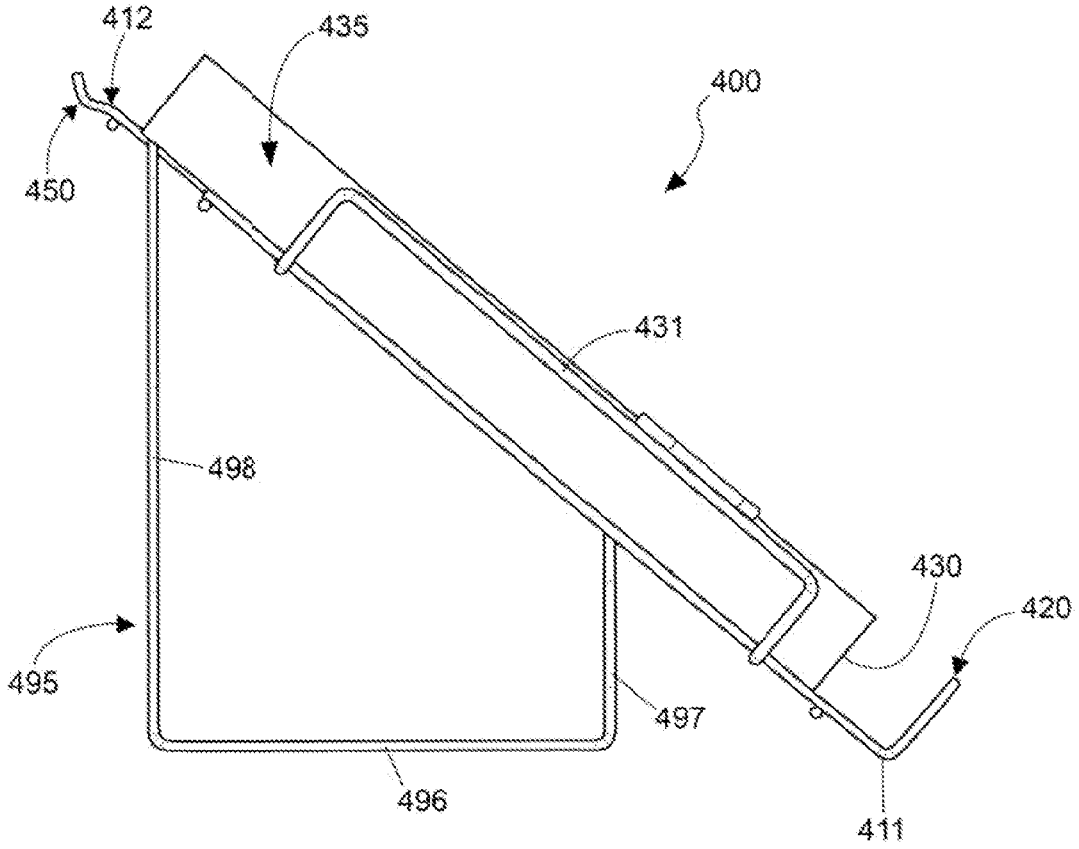
FIG. 10 is a left-side view of the base rack of FIG. 9.

Referring now to FIGS. 9 and 10 concurrently, a base rack 400 is illustrated according to an embodiment of the present invention. The base rack 400 is similar to the rack 100 discussed above with respect to FIGS. 1-4 with the exception that the base rack 400 comprises a base structure 494 instead of alignment portions. In order to avoid redundancy, only certain aspect of the base rack 400 will be described herein with the understanding that the discussion of the rack 100 is applicable to the base rack 400 in all other regards. To this extent, a similar numbering scheme is used in the drawings for the base rack 400 as is used for the rack 100 with the exception that the reference numbers are in the "400" series.

The base rack 400 comprises a rack structure 405 and a base structure 495. The rack structure 405 is similar to the rack 100, including a floor 410, a front retaining portion 420, and lateral retaining portions 430, 440 that collectively form a space 490 for supporting and retaining a stack of posterboard. The base structure 495 is connected to and extends from the bottom of the rack portion 405. More specifically, base structure 495 connects to the floor 410 of the rack portion 405.

The base structure 495 comprises rear vertical legs 498, front vertical legs 497 and horizontal members 496. The horizontal members 496 connect the rear vertical legs 498 and the front vertical legs 497 and lay flat atop a horizontal support surface, such as the floor or a deck of an existing shelving unit, within a store. The rear vertical legs 498 are taller than the front vertical legs 497, thereby supporting the rack portion 405 in an angled manner so that the plane formed by the floor 410 slopes downward at the angle Θ from the rear 412 to the front 411, wherein the angle Θ is the same as angle discussed above with respect to FIGS. 5-6 that is formed between the floor 110 of the rack 100 and the vertical wall 300. While the angle Θ is exemplified as being measured between the vertical rear leg 498 and the floor 410 of the base rack 400, it can be measured between the floor 410 and any vertical surface, such as the wall 300.

The base structure 495 can be formed in a wide variety of configurations and with a wide variety of structural members, including plates, beams, wires, blocks and combinations thereof. The base rack 400 is designed to be placed upon a horizontal support surface so that the weight of the base rack 400 (and its load) are supported by the horizontal support surface. While the base rack 400 comprises support members 450, the base rack 400 is not supported in a cantilevered manner. While the support members 450 may be inserted into holes 301 of a vertical wall 300 to prevent accidental dislodgement, they can be omitted if desired.

Figure 11:
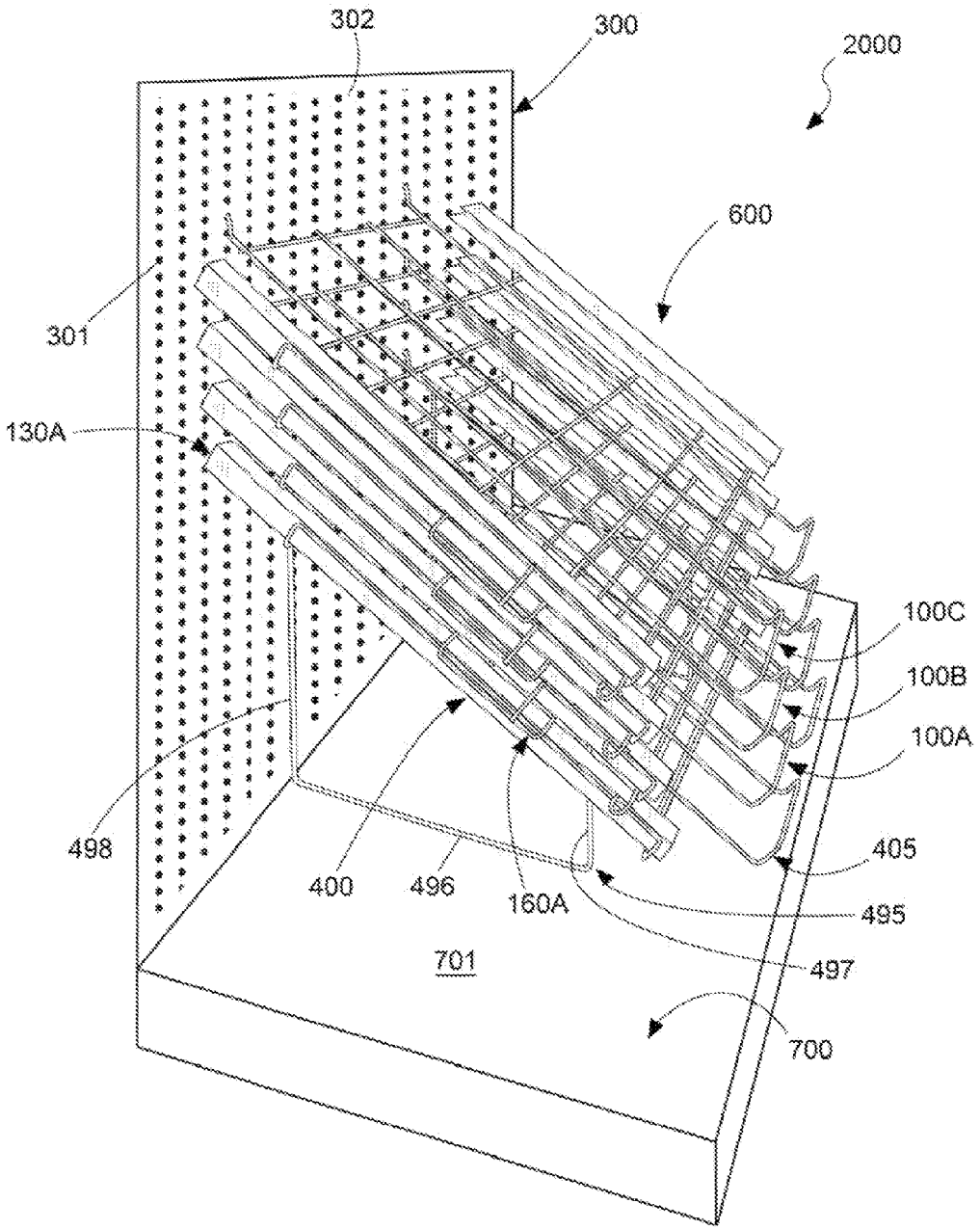
FIG. 11 is an isometric view of a rack system according a second embodiment of the present invention wherein the base rack of FIG. 9 and a plurality of the racks of FIG. 1 are mounted to the vertical pegboard wall in a stacked assembly.

By nature of it being supported by a horizontal support surface, the base rack 400 is particularly suited to carry very large loads in a structurally stable manner. To this extent, when the base rack 400 is incorporated into a posterboard display 2000 (as shown in FIG. 11), the base rack 400 is preferably loaded with white posterboard which tends to be the most numerous and voluminous inventory. In such an embodiment, it may be desirable that the front retaining portion 420 and lateral retaining portions 430, 440 of the base rack 400 have a height that is greater than the height of the front retaining portion 120 and lateral retaining portions 130, 140 of the remaining racks 100A-C within the stacked assembly 600 of the posterboard display 2000. This increases the depth of the space 490 in which posterboard can be supported and retained.

While the base rack 400 is exemplified as having a single rack portion 405, it should be understood that the base rack 400 could comprise more than one rack portions 405 that are integrally and inseparably connected to together.

Referring now to FIG. 11, a posterboard display 2000 according to an embodiment of the present invention is illustrated. The posterboard display 2000 generally comprises the base rack 400 and the cantilever racks 100A-C which are loaded with posterboard (not illustrated). The base rack 400 and the cantilever racks 100A-C are arranged in a stacked assembly 600. Preferably, each rack 400, 100A-C are loaded with different colors of posterboard, wherein the base rack 400 is loaded with white posterboard.

In creating the posterboard display 2000, the base rack 400 is first positioned atop the top horizontal surface 701 of the deck 700 of an existing shelving unit within a retail store. In certain embodiments, the invention may include the vertical wall 300 and the deck 700. The base rack 400 is positioned so that the horizontal members 496 rest atop the top horizontal surface 701 of the deck 700 and is adjacent to the front surface 302 of the vertical pegboard wall 300. More specifically, the rear vertical legs 498 of the base rack are abutted against the front surface 302 of the vertical pegboard wall 300. The support members 450 of the base rack are slidably inserted into the desired holes 301 of the wall 300 to facilitate a flush positioning of the base rack 400 against the wall 300 and to prohibit accidental dislodgement.

Once the base rack 400 is in position, the racks 100A-C are mounted to the vertical wall in the cantilevered manner and angled orientation discussed above with respect to FIGS. 5-6, thereby forming the stacked assembly 600. Of note, the lateral retaining portions 430, 440 of the base rack 400 nest within the space between the alignment portions 160A, 170A of the rack 100A while the floor 110 of the rack 100A rests atop the lateral retaining portions 430, 440 of the base rack 400.

Once the stacked assembly 600 is created, the base rack 400 is preferably loaded with a white posterboard stack by sliding posterboard into the space 490. Subsequently, each of the racks 100A-C is then loaded with a posterboard stack of a different color by sliding the colored posterboards into the spaces 190A-C.

Each of the base rack 400 and the racks 100A-C remain independent and separable structures, thereby resulting in a display 2000 that can be easily adjusted in height by removing and/or adding additional racks 100 to correspond to changing inventory needs. As a result, no more space than necessary is taken up by the posterboard display 2000 than is required by the available posterboard inventory. It is also preferred that the front retaining portions of each of the base rack 400 and the racks 100A-C do not extend beyond the front edge of the deck 700 so that it is not contacted by shopping carts or consumers walking in the aisles.

Figure 12:
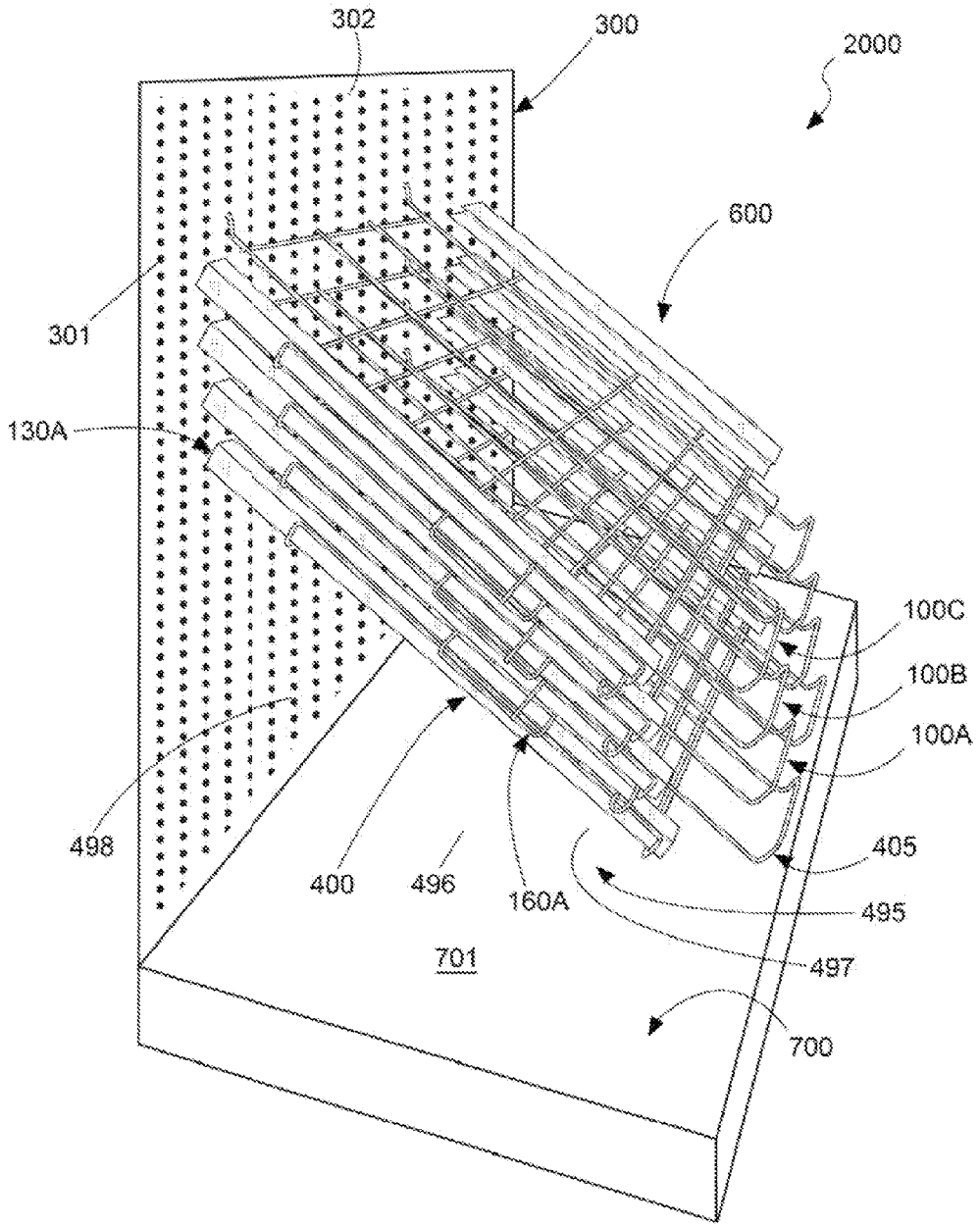
FIG. 12 is an isometric view of the rack system of FIG. 7 wherein a lower-most rack in the stacked assembly rests atop a horizontal deck of the shelf.

Referring now to FIG. 12, the rack system 2000 is illustrated wherein a lower-most rack 100A in the stacked assembly 600 rests atop the top surface 701 of the deck 700. More specifically, in supporting the lower-most rack 100A to the pegboard wall 300, holes 301 are selected at a height so that when the lower-most rack 100A is slid into those holes 301 and supported (as discussed above), the front edge 111 of the lower-most rack 100A contacts the top surface 701 of the deck 700. The remaining racks 100B-C are then added to the stacked assembly 600 as discussed above.

In certain aspects, this arrangement of the lower-most rack 100A is preferable in that the same stacked assembly 600 can be formed on decks 700 having different depths while still maximizing the depth of the deck 700. For example, the rack system 2000 can be formed on a deck 700 having a 15 inch depth or an 18 inch depth (measured from the vertical wall to the front edge) by simply selecting holes 701 at different vertical heights from the deck 700 for mounting the lower-most rack 100A. Despite being used on decks of varying depth, the racks 100A-C can be mounted so that the front retaining portions 120A-C remain near the front edge of the deck 700, thereby affording easy consumer access.

While the invention has been described and illustrated in detail, various alternatives and modifications will become readily apparent to those skilled in the art without departing from the spirit and scope of the invention. For example, in certain embodiments of the invention that incorporate the U-channels 135, the rack 100 may not be limited to being supported in a cantilevered manner from a vertical wall. In such an embodiment, a plurality of the racks 100 may be arranged in a spaced-apart and stacked assembly and incorporated into a stand-alone rack having vertical posts connected to the racks 100.

What is claimed is:

1. A modular racking system comprising:

a plurality of racks, each rack comprising:

a floor for supporting a flat article, the floor having a front, a rear, and lateral sides;

a front retaining portion extending upward from the floor at the front of the floor;

first and second lateral retaining portions extending upward from the floor along the lateral sides of the floor;

at least two support members extending from the rear of the floor that engage a vertical wall and support the rack in a cantilevered manner and oriented so that the floor slopes downward and away from the vertical wall; and the racks mounted to the vertical wall in a stacked assembly so that the floor of an upper rack in the stacked assembly rests atop and directly contacts the first and second lateral retaining portions of a lower adjacent rack in the stacked assembly;

wherein each rack further comprises first and second alignment portions extending downward from the floor along the lateral sides of the floor, and wherein the first and second lateral retaining portions of the lower adjacent rack in the stacked assembly nest within the first and second alignment portions of the upper rack in the stacked assembly;

wherein the racks are wire frame racks and each of the first and second lateral retaining portions comprise a U-channel tubular member comprising a roof plate, a floor plate and a wall plate connecting the roof plate and the floor plate.

2. The modular racking system of claim 1 wherein the floor of each of the racks in the stacked assembly slopes downward and away from the vertical wall at the same angle.

3. The modular racking system of claim 1 wherein each of the first and second lateral retaining portions comprise an elongated channel having an open front end, and wherein the open front ends of the elongated channels are offset a distance from the front of the floor toward the rear of the rack.

4. The modular racking system of claim 1 wherein the first and second lateral retaining portions of the upper rack are oriented parallel to the first and second lateral retaining portions of the lower adjacent rack.

5. The modular racking system of claim 1 wherein the first and second lateral retaining portions comprises a protuberance on a top surface of a front portion of the first and second lateral retaining portions, the floor of the upper rack in the stacked assembly resting atop the protuberances of the first and second lateral retaining portions of the lower adjacent rack in the stacked assembly.

6. The modular racking system of claim 1 wherein each of the support members comprise a first section extending upward from the floor at an obtuse angle and resting against a front surface of the vertical wall, a second section connected to and extending from a distal end of the first section and through a hole in the vertical wall, and a third section connected to and extending from a distal end of the second section and resting against a rear surface of the vertical wall.

7. The modular racking system of claim 6 wherein the weight of the rack creates a moment about the second section that presses the first section against the front surface of the vertical wall at a location below the hole while concurrently pressing the third section against the rear surface of the vertical wall at a location above the hole, thereby resulting in the rack being self-supported in the cantilevered manner.

8. The modular racking system of claim 1 wherein the floor of the upper rack is spaced apart from the floor of the lower rack.

9. A modular rack system comprising:

a wire frame rack having a floor, a front wall and first and second lateral retaining portions extending upwardly from the floor along lateral sides of the floor that collectively define a product retaining space for flat articles, the floor formed by a first plurality of linear wires extending between the lateral sides of the floor and a second plurality of linear wires extending between the front wall and a rear of the wire frame rack, the wire frame rack oriented so that the floor slopes downward from the rear of the wire frame rack to the front wall;

wherein a first set of the first plurality of linear wires are bent downwardly to form first and second alignment portions that extend downwardly from the floor along the lateral sides of the floor; and wherein a second set of the first plurality of linear wires are bent upwardly to form a wire portion of the first and second lateral retaining portions, wherein each of the lateral retaining portions comprises the wire portion and an elongated channel that is formed by a U-channel tubular member comprising a roof plate, a floor plate and a wall plate connecting the roof plate and the floor plate;

wherein the modular rack system further comprises a plurality of the wire frame racks arranged in a stacked assembly, wherein the floor of an upper wire frame rack in the stacked assembly rests atop the lateral retaining portions of a lower adjacent wire frame rack in the stacked assembly, and wherein the lateral retaining portions of the lower adjacent rack in the stacked assembly nest within the corresponding first and second alignment portions of the upper rack in the stacked assembly.

10. The modular rack system of claim 9 wherein each floor plate is positioned atop the floor and each wall plate is positioned adjacent to a corresponding wire portion of a respective first or second lateral retaining portion, each elongated channel having an open front end that is offset a distance from the front wall of a corresponding rack.

11. The modular rack system of claim 9 wherein each wire frame rack is supported by a vertical wall in a cantilevered manner, wherein the vertical wall is a pegboard wall, and wherein each wire frame rack further comprises at least two support members extending from the rear of a corresponding wire frame rack, wherein each of the support members comprise a first section extending upward from a corresponding floor at an obtuse angle and resting against a front surface of the pegboard wall, a second section connected to and extending from a distal end of the first section and through a hole in the pegboard wall, and a third section connected to and extending from a distal end of the second section and resting against a rear surface of the pegboard wall, wherein the weight of each wire frame rack presses the first sections against the front surface of the pegboard wall at a location below a corresponding hole while concurrently pressing the third section against the rear surface of the pegboard wall at a location above the corresponding hole, thereby resulting in each rack being self supported in the cantilevered manner.

12. The modular rack system of claim 9 wherein when the plurality of the wire frame racks are arranged in the stacked assembly the floor of the upper wire frame rack in the stacked assembly rests atop and is in surface contact with protuberances on top surfaces of the lateral retaining portions of the lower adjacent wire frame rack in the stacked assembly, and wherein the rear of the wire frame racks are each mounted to a vertical wall so that the wire frame racks are supported in a cantilevered manner.

13. The modular rack system of claim 9 wherein, the rear of each wire frame rack is mounted to a vertical wall so that the wire frame racks are supported in a cantilevered manner; and wherein the rear of the wire frame rack is slidably mounted to the vertical wall.

14. A paper board product display comprising:

a plurality of racks, each of the racks comprising a floor, a front retaining portion extending upward from the floor, and lateral retaining portions extending upward from the floor that collectively define a space for holding paper board product, wherein each of the racks further comprises first and second alignment portions extending downward from the floor, the floor being oriented at an acute angle relative to a vertical wall;

the racks arranged in a stacked assembly so that the floor of an upper rack in the stacked assembly rests atop and is in surface contact with the lateral retaining portions of a lower adjacent rack in the stacked assembly; wherein the lateral retaining portions of the lower adjacent rack in the stacked assembly nest within the first and second alignment portions of the upper rack in the stacked assembly; wherein each of the racks in the stacked assembly are separable from one another;

wherein the racks are wire frame racks and each lateral wall comprises a U channel tubular member comprising a floor plate, a roof plate and a wall plate connecting the floor plate and the roof plate;

wherein a lower-most rack in the stacked assembly comprises a base structure, the base structure comprising a rear vertical leg, a front vertical leg and a horizontal member connecting the rear and front vertical legs to one another, each of the rear and front vertical legs connected to and extending downwardly from the floor of the lower-most rack, the horizontal member resting directly atop and supported by a horizontal surface;

wherein the remaining racks in the stacked assembly are mounted to the vertical wall and supported in a cantilevered manner; and one or more paper board products positioned within the spaces and lying substantially flat atop the floors of the racks, the one or more paper board products retained within the spaces by the front retaining portions and the lateral retaining portions.

15. The paper board product display of claim 14 wherein peripheral edge portions of the one or more paper board products nest within corresponding U-channel tubular members.

16. The paper board product display of claim 14 wherein the rear the rear vertical leg is taller than the front vertical leg so that the floor of the lower-most rack in the stacked assembly is supported at the acute angle relative to the vertical wall, and wherein the rear vertical leg is abutted against a front surface of the vertical wall.

* * * * *